United States Patent [19]

Bridgeman

[11] Patent Number: 5,064,408

[45] Date of Patent: Nov. 12, 1991

[54] METHOD AND APPARATUS FOR PRODUCING A PLURALITY OF CONTINUOUS BAGS

[76] Inventor: Daniel N. P. Bridgeman, P.O. Box 1048, San Carlos, Calif. 94070

[21] Appl. No.: 684,443

[22] Filed: Apr. 11, 1991

Related U.S. Application Data

[63] Continuation of Ser. No. 571,027, Aug. 22, 1990, abandoned, which is a continuation of Ser. No. 291,610, Dec. 29, 1988, abandoned.

[51] Int. Cl.[5] ..... B31B 23/14; B31B 27/16

[52] U.S. Cl. ..... 493/194; 493/198; 53/385.1; 225/100

[58] Field of Search ..... 493/194, 195, 196, 197, 493/198, 230, 233, 256, 257; 225/100, 101; 53/384, 385, 386

[56] References Cited

U.S. PATENT DOCUMENTS

| | | | |
|---|---|---|---|
| 3,254,828 | 6/1966 | Lerner | 493/195 |
| 3,269,087 | 8/1966 | Cloud et al. | 493/196 |
| 3,579,948 | 5/1971 | Lerner | 53/385 |
| 3,743,567 | 7/1973 | Abler | 493/198 |
| 4,500,307 | 2/1985 | Bridgeman | 493/198 |
| 4,694,638 | 9/1987 | Maddux, Jr. et al. | 225/100 |

*Primary Examiner*—William E. Terrell
*Attorney, Agent, or Firm*—Limbach, Limbach & Sutton

[57] ABSTRACT

A method and apparatus for producing continuous bags, each bag having an opening on one side from a length of continuous tubing is disclosed. The bags are produced along a direction of production and each bag produced has a sealed end and line of perforation opposite to the sealed end. Each bag is positioned with its sealed end immediately adjacent to the line of perforation of an adjacent bag. The bags are produced by advancing a length of continuous tubing along the direction of production and sealing the tubing at a first location by a sealing means to form a sealed end of a first bag and substantially simultaneously perforating the tubing at a second location immediately adjacent to the sealed end of the first bag by a perforating means to form a line of perforation of a second bag. The second bag is immediately adjacent to the first bag. One layer of the tubing is then severed at the line of perforation without substantially severing the other layer by moving the upper layer relative to the other layer in a direction opposite to the direction of production. Lastly, the method comprises the step of advancing the tubing along the direction of production to form the plurality of continuous bags.

9 Claims, 6 Drawing Sheets

METHOD AND APPARATUS FOR PRODUCING A PLURALITY OF CONTINUOUS BAGS

This is a continuation of co-pending application Ser. No. 07/571,027 filed on Aug. 22, 1990, abandoned which is a continuation of abandoned application Ser. No. 07/291,610 filed on Dec. 29, 1988.

TECHNICAL FIELD

The present invention relates generally to a method and apparatus for producing a plurality of continuous bags. More specifically, the present invention relates to a method and apparatus for producing continuous bags wherein each bag has an opening on a side.

BACKGROUND OF THE INVENTION

Numerous methods and devices are known for producing continuous bags of thin material, such as polyethylene. One well known example is the plastic bag commonly used in grocery stores or supermarkets. These bags are characterized by being in a continuous row on a reel with perforations through the bag separating one bag from the other. To use each bag, the shopper grasps a bag, tugs the bag thereby tearing it from the reel along a line of perforation which marks the end of one bag and the beginning of the adjacent bag on the reel. Thus, the line of perforation serves as the connection between one bag and another while on the reel as well as the opening of a bag once torn along the line perforation.

It is, however, desireable in certain applications to manufacture such continuous bag with each bag connected to the adjacent bag but having an opening along one side of the perforation. Such continuous bags are used in other manufacturing processes in which items are inserted into each bag through the opening in a continuous fashion. Thus, in such applications, it is desireable to manufacture continuous bags of thin material with each of the bags having an opening on a side.

Methods and apparati for the manufacture of continuous bags wherein each bag has an opening on a side are known. For example, my U.S. Pat. No. 4,500,307 entitled "Apparatus for Producing Continuous Bags of Thin Wall Material" (issued Feb. 19, 1985) discloses one such method and apparatus. In my previously patented invention, a length of continuous tubing is transformed to a length of continuous bags, each bag having an opening on a side and yet connected to one another by a line of perforation, is produced by twisting the tubing 90 degrees in one direction, passing the twisted tubing in a direction of production over a roller wherein one half of the roller has a cutting edge and the other half has a perforating blade, twisting the tubing 90 degrees in a direction opposite to the first twist to return it to its original orientation, and passing the tubing through a means for sealing the two layers of tubing together further down along the direction of production.

My previous invention had suffered from several disadvantages. Firstly, it did not conveniently allow for the adjustment of the length of the bags produced. The length of the bag product in that invention was a function solely of the size of the outer diameter of the cutting/perforating roller, which also functioned to advance the tubing along the direction of production. Bags produced from that method and device were roughly equal to the distance around the perimeter of the cutting/perforating roller. Thus, in order to change the length of the bag produced, it was necessary to use a different roller with a different outer diameter.

Secondly, the means for sealing the tubing to form the bottom end of bags is disposed a substantial distance away from the cutting/perforating roller along the direction of production. Thus, the tubing is perforated, advanced a distance and sealed. The sealing means seals the tubing to form the bottom of a bag by making physical contact with the tubing at a point adjacent to one of the lines of perforation/cut which had previously been made by the roller some distance before. Thus, the precision with which the perforating/cutting roller and the sealing means work together in synchronicity is an important factor in the successful operation of my prior device. Such synchronicity is difficult to achieve given the fact that the perforating/cutting roller and sealing means are separated by quite a distance.

There is, thus, a need for a method and apparatus for producing continuous bags having an opening on one side in which the length of the bags produced are easily adjusted. There is a further need for such a method and apparatus wherein the synchronicity necessary for the cooperation of the perforating, cutting and sealing steps is more easily attained.

The present invention addresses these needs and others.

SUMMARY OF THE INVENTION

The present invention provides a novel method and apparatus for producing a plurality of continuous bags as well as a novel method and apparatus for producing a plurality of bags having one side open. The method produces the continuous bags along a direction of production. Each bag produced has a sealed end and line of perforation opposite to the sealed end and each bag positioned with its sealed end immediately adjacent to the line of perforation of an adjacent bag.

The method comprises the step of supplying a continuous length of advancing tubing along the direction of production. The tubing has a first layer and a second layer. The next step comprises sealing the first and second layers of the tubing together at a first location by a sealing means to form a sealed end of a first bag. Substantially simultaneous to the sealing step is a perforating step wherein the first and second layers of the tubing are perforated at a second location immediately adjacent to the sealed end by a perforating means to form a line of perforation of a second bag. The second bag is immediately adjacent to the first bag. Lastly, the method comprises the step of advancing the tubing along the direction of production past the sealing means and past the perforating means to form the plurality of continuous bags.

In an embodiment of the method of the present invention, a plurality of bags having an opening on one side is produced by frictionally engaging the tubing at its first layer and moving the first layer relative to the second layer of the tubing.

The apparatus of the present invention comprises means for sealing the first and second layers of the tubing together at a first location to form a sealed end of a first bag. The apparatus also includes means for perforating the first and second layers of the tubing at a second location immediately adjacent to the sealed end to form a line of perforation of a second bag. The second bag is immediately adjacent to the first bag. The apparatus further includes means for actuating the sealing means and the perforating means substantially simultaneously and means for advancing the tubing along the direction of production past the sealing means and past perforating means to form the plurality of continuous bags.

In an embodiment of the apparatus of the present invention, a plurality of bags having an opening on one side is produced by including means for frictionally engaging the tubing at its first layer and means for moving the first layer relative to the second layer of the tubing.

The invention is described below in greater detail with reference to the accompanying drawings which depict difference views of a device of the present invention.

DETAILED DESCRIPTION OF THE INVENTION

Figure 2:
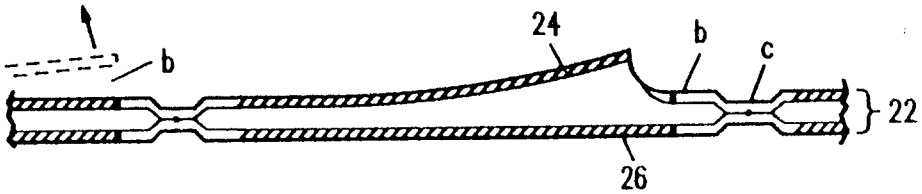
FIG. 2 is a cross sectional view of the continuous tubing shown in FIG. 1 taken along line 2—2.
Figure 8:
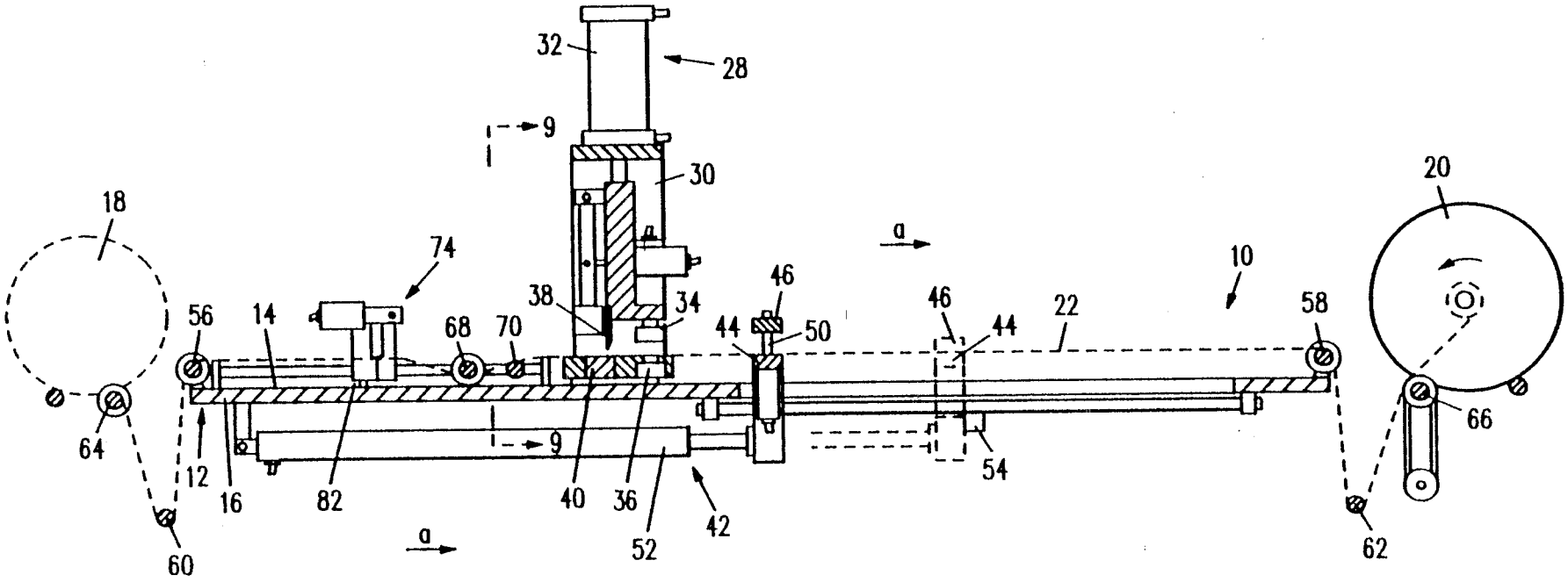
FIG. 8 is a side view of a device of the present invention.

A device of the present invention is shown generally in the accompanying drawings as reference numeral 10. As shown in FIG. 8, the device comprises a flat, elongated horizontal member 12 having an upper surface 14 and a lower surface 16. A supply reel 18 is disposed at one end of horizontal member 12. An uptake reel 20 is disposed at the opposite end of horizontal member 12. A length of continuous tubing 22 is disposed along the length of horizontal member 12 such that one end of tubing 22 is wrapped around supply reel 18 and the other end is wrapped around uptake reel 20 and a length of tubing 22 is disposed therebetween. As shown in FIG. 2, continuous tubing 22 has a first layer 24 and a second layer 26.

The device also includes a frame 28 positioned above upper surface 14 and at approximately the middle of the length of horizonal member 12 in which is housed an actuating member 30. Actuating member 30 is capable of vertical motion toward and away from upper surface 14 of horizontal member 12. The vertical motion of actuating member 30 can driven by any known means. In the embodiment illustrated in FIG. 8, actuating member 30 is pneumatically driven by an oil or air cylinder 32 disposed at the end of actuating member 30 which is most distal to horizontal member 12. Alternate side views of frame 24 and its contents are shown in FIGS. 3, 4, 5, 8, 10 and 11.

The device of the present invention also includes a sealing means for sealing tubing 22 across its width at a first location to form the sealed end of a bag. In the illustrated embodiments, tubing 22 is comprised of a material whioh is heat sealable such as polyethylene, and the sealing means, as shown in FIGS. 3, 4, 5 and 11, comprises a heating element 32 disposed on upper surface 14 of horizonal member 12 and a pressure member 34 positioned directly above heating element 32. Pressure member 34 is disposed on the end of actuating member 30 which is most proximal to horizontal member 12.

The device of the present invention also includes a perforating means for perforating tubing 22 across its width at a first location to form a line of perforation which will define the open end of a bag. In the illustrated embodiment, the perforating means comprises a perforating blade 38 and an anvil 40. Perforating blade 38 is disposed on the end of actuating member 30 which is most proximal to horizontal member 12 and across the width of horizontal member 12. Anvil 40 is disposed on upper surface 14 of horizontal member 12 directly opposite perforating blade 38 in order to receive it when perforating blade 38 is lowered by actuating member 30 as shown in FIGS. 4, 5, 10 and 11. Perforating blade 38 is also adjacent and parallel to pressure member 34 on actuating member 30.

As can be appreciated, actuating member 34, in addition to raising and lowering perforating blade 38 and pressure member 34 toward and away from anvil 40 and heating element 32, respectively, also functions to coordinate and synchronize the sealing and perforating means such that they operate substantially simultaneously. Further, in the device and method of the present invention, tubing 22 is not advanced between the sealing and perforating steps. This feature offers significant advantages over the prior known methods and devices, including those of my previous patented invention.

The device also includes an advancing means for advancing tubing 22 from supply reel 18 toward uptake reel 20 in a direction shown in the Figures as "a", which is also known as the direction of production. The advancing means of the illustrated embodiment comprises an advancing assembly shown generally in the drawings as 42. As shown in FIG. 8, advancing assembly 42 comprises two parallel rods 44 and 46 disposed above and across the width of upper surface 14 of horizontal member 12. Rods 44 and 46 are connected to one another by a pair of cylinders 48 and 50 which is capable of vertically moving rod 46 relative to horizontal member 12 and allows rod 46 to move vertically toward and away from rod 44 with tubing 22 therebetween. Cylinders 48 and 50 may be driven by any known means. In the illustrated embodiment, it is driven pneumatically. As shown in FIG. 8, parallel rod 44 is attached to another cylindrical driving mechanism 52 which is disposed near lower surface 16 of horizontal member 12, which is capable of moving the rods 44 and 46 along direction of production "a".

Figure 3:
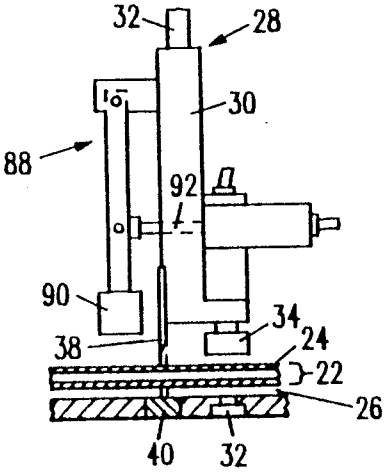
FIG. 3 is a side view of a portion an embodiment of a device of the present invention in which the sealing and perforating means are in a raised position.

In operation, tubing 22 is advanced from supply reel 18, over upper surface 14 of horizontal member 12, between perforating blade 38 and anvil 40, between pressure member 34 and heating element 36, between parallel rods 44 and 46 to uptake reel 20. Once tubing 22 is properly threaded into the device, actuating member 30 is driven downward toward tubing 22 such that pressure member 34 engages tubing 22 and pushes it against heating element 36. Substantially simultaneous thereto, perforating blade 38 engages with tubing 22 and pushes down against anvil 40, which is typically made of rubber. Perforating blade 38 in the upward position, as shown in FIGS. 3 and 8, extends farther out from the end of actuating member 30 and closer to tubing 22 than does pressure member 34. Thus, when actuating member 30 drives perforating blade 38 downward, perforating blade 38 cuts through both layers 24 and 26 of tubing 22 and is embedded in anvil 40, thus creating a line of perforation in tubing 22 at a first location "b". Meanwhile the substantially simultaneous engagement of tubing 22 to heating element 32, which is facilitated by the downward pressure applied to tubing 22 by pressure member 34, allows for sealing of tubing 22 at a second location "c". Actuating member 30 should be allowed to remain in the lowered position for a period of time sufficient to allow the sealing process to be completed. The time in which actuating member 30 is in this downward position is dependant upon the material which comprises tubing 22, its composition and thickness, and the temperature of heating element 32. As can be appreciated, tubing 22 must be in contact with heating element 32 for sufficient time to allow the sealing process to be completed. However, undue delay in the downward position may result in overheating and weakening of the tubing at the second location. Actuating member 30 is then driven vertically upward and away from horizontal member 12. The result is a line of perforation which defines the open end of one bag and a parallel sealed line which defines the sealed end of another adjacent bag. Thus, the beginning of one bag as defined by the line of perforation is created substantially simultaneous to the creation of the sealed end of an adjacent bag.

After actuating member 30 is raised upward and perforating blade 38 is fully withdrawn from tubing 22, tubing 22 is advanced along direction of production "a"by advancing assembly 42. In this step, cylinders 48 and 50 are driven downward to cause rods 44 and 46 to come together. In so doing, rods 44 and 46 clamp about tubing 22 at its width. Cylindrical driving mechanism 52 then pushes rods 44 and 46, along with the tubing clamped between them, in direction of production "a" an incremental distance. This step is shown as dotted lines in FIGS. 7 and 8. Cylinders 48 and 50 then recede, causing rods 44 and 46 to separate and their grip on tubing 22 to release. Cylindrical driving mechanism 52 then recedes and returns to its starting position.

As can be appreciated, the incremental distance in which tubing 22 is advanced should be substantially equal the length of the bag to be produced. In one embodiment shown in the drawings, the incremental distance is adjustable by placing a brake 54 along lower surface 16 of horizontal member 12 to physically limit the distance along the direction of production in which cylindrical driving mechanism 52 may advance.

Figure 7:
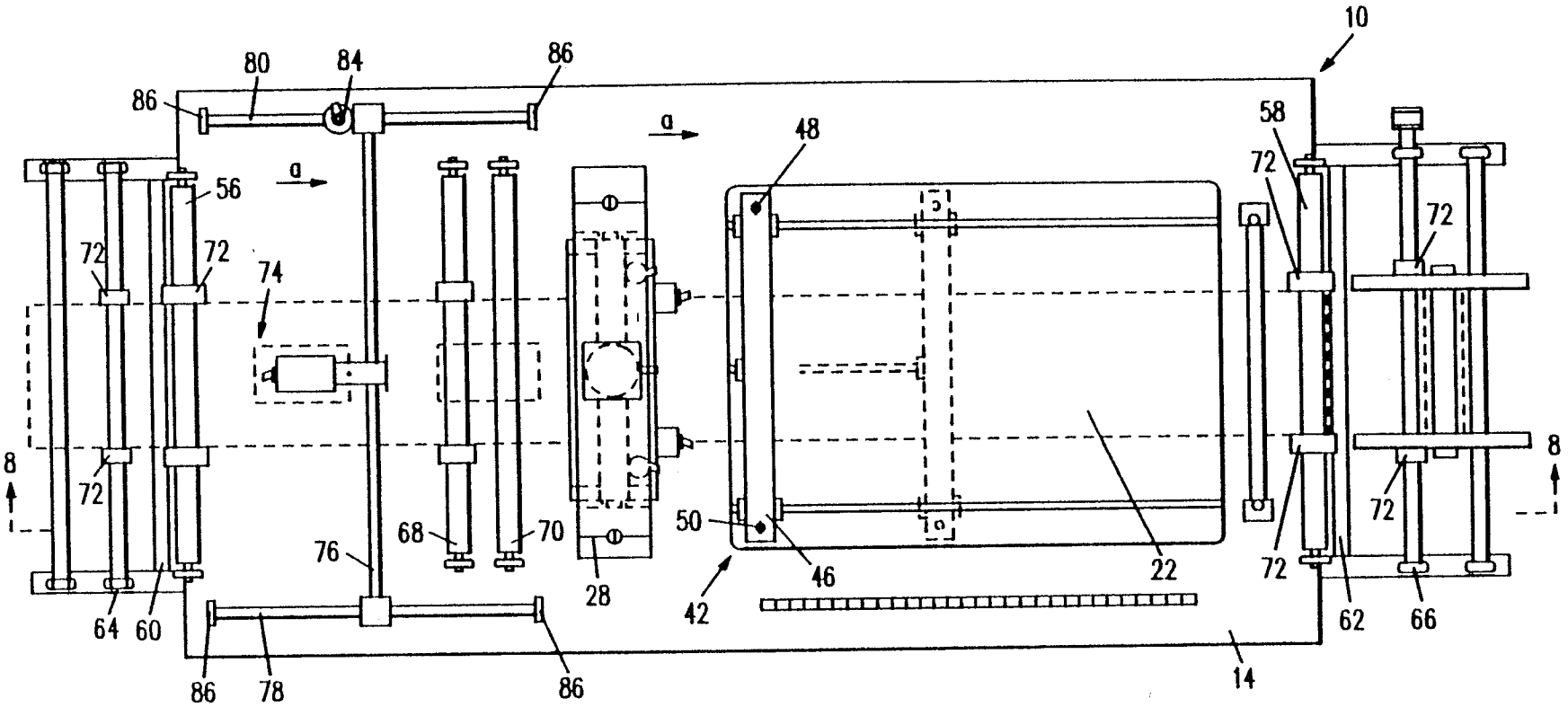
FIG. 7 is a top view of a device of the present invention.

In an alternate embodiment, which is also shown in FIGS. 7 and 8, the incremental distance is adjustable with the aid of an optical reading assembly 74. This embodiment is useful where the bags to be produced have printed matter contained thereon. In such a case, tubing 22 also contains such printed matter on at least one of layers 24 or 26 which, preferably, is regularly placed thereon. Optical reading assembly 74 comprises an electric eye 82 which is slidably mounted on a horizontal rod 76 and disposed on the device so that it is above first layer 24. Horizontal rod 76 is slidably mounted on two parallel longitudinal rods 78 and 80. As can be appreciated, this arrangement of rods allows for facile adjustment of the position of electric eye 82 to accommodate the location of printed matter on tubing 22. Electric eye 82 may be adjusted horizontally along horizontal rod 76 and longitudinally along parallel rods 78 and 80. Rods 78 and 80 are also provided with permanent barriers, shown collectively in FIG. 8 as 86, beyond which horizontal rod 76 cannot slide. An adjustable barrier 84 is also provided and slidably mounted onto one of rods 78 and 80 to secure the longitudinal position of horizontal rod 76.

In this alternate embodiment, the purpose of electric eye 82 is to "read" tubing 22 as it is advanced thereunder for printed matter. When electric eye 82 detects printed matter it sends, a signal to cylindrical driving mechanism 52 to either recede or extend along direction of production "a". These signals may be conveyed from electric eye 82 to cylindrical driving mechanism 52 with the assistance of a computer device (not shown).

Once tubing 22 is advanced and cylindrical driving mechanism 52 returns to its starting position, the process begins again. Actuating member 30 is again driven downward toward tubing 22 and engages tubing 22 with pressure member 34 and heating element 36 and is simultaneously perforated. Actuating member 30 is driven upward again and advancing assembly 42 in combination with cylindrical driving mechanism 52 advances tubing 22 along direction "a" another incremental distance and returns to its starting position.

As can be appreciated these series of steps repeated many times over results in a continuous serial arrangement of bags attached to one another such that the end to be the top of one bag (defined by a line of perforation) in the series is immediately adjacent to the end to be the bottom of another bag (defined by a seal) which is next in the series.

In operation the device of the present invention, it has been found that tubing 22 should be kept relatively taut during operation in order to maintain consistency in the position of the tubing while the various steps are being performed and to insure proper perforating, sealing and uptake. In this regard, it has been found advantageous to supply the device with a system of rollers and dancers such as that shown in FIGS. 7 and 8. The device illustrated in FIG. 8 includes a pair of rollers 56 and 58 disposed on horizontal member 12, one at each end. Tubing 22 is made to pass over rollers 56 and 58. The device also includes a pair of lower dancers 60 and 62, under which tubing 22 is looped, one between the end of horizontal member 12 and supply roller 18 and the other between the end of horizontal member 12 and uptake roller 20. Dancers 60 and 62 are in a position which is lower than the height of horizontal member 12 and the outer perimeter of reels 18 and 20. Another roller 64 is positioned adjacent to supply reel 18 and another roller 66 is positioned adjacent to uptake reel 20. As can be appreciated, rollers 56 and 58 facilitate smooth motion of tubing 12 along direction of production "a". Dancers 60 and 62 provide downward pressure and stretch tubing 22 to the appropriate tension. Rollers 64 and 66 facilitate smooth release and uptake of tubing 22 respectively.

To provide further tension and smooth movement of tubing 22, uptake roller 20 of device illustrated in FIG. 8 also is driven. A pair of rollers 68 and 70 are disposed on upper surface 14 of horizontal member 12 between supply reel 18 and actuating member 30. Tubing 22 is made to pass under roller 68 and over roller 70 which is near actuating member 30. Rollers 56, 58 and 68 and dancers 60 and 62 are each provided with a pair of disc shaped guides, shown collectively in FIG. 8 as 72, between which tubing 22 is made to pass. Guides 72 keep tubing 22 in its intended path.

Figure 1:
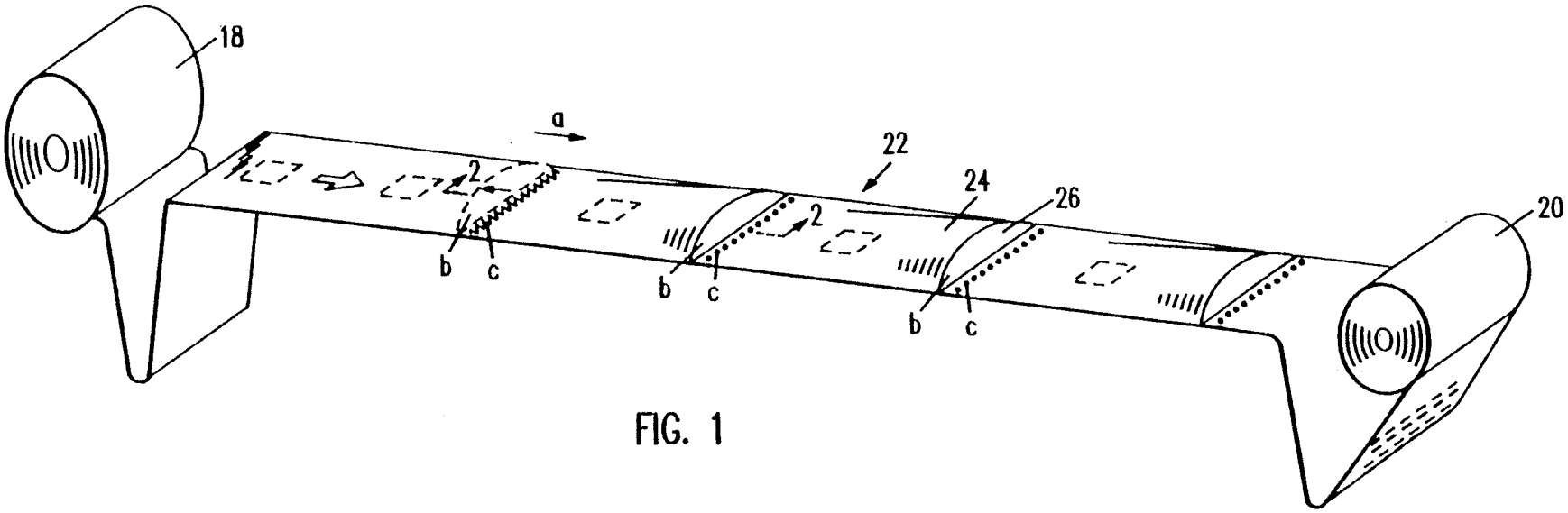
FIG. 1 is a perspective view of a length of continuous tubing used with a device of the present invention.

In a preferred embodiment of the present invention, the continuous bags produced by the device and method of the present invention are open on one side as depicted in FIGS. 1 and 2. This result is achieved in the present invention by severing first layer 24 of tubing 22 at the line of perforation which without substantially severing second layer 26. The severing step comprises frictionally engaging first layer 24 and moving it relative to second layer 26. The relative movement can be substantially opposite to direction of production "a" or perpendicular to direction of production "a".

Figure 5:
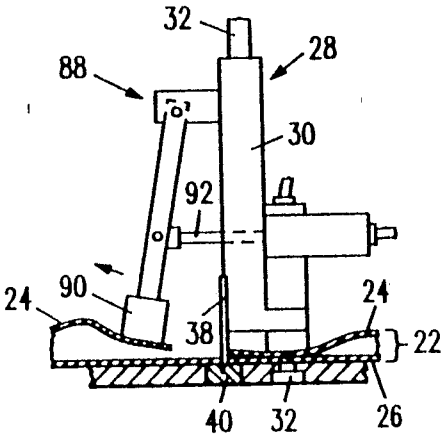
FIG. 5 is a side view of the portion of the embodiment shown in FIG. 3 in which the sealing and perforating means are in the lowered position and wherein a kicker member is frictionally engaging and severing the first layer of the continuous tubing at a line of perforation.
Figure 4:
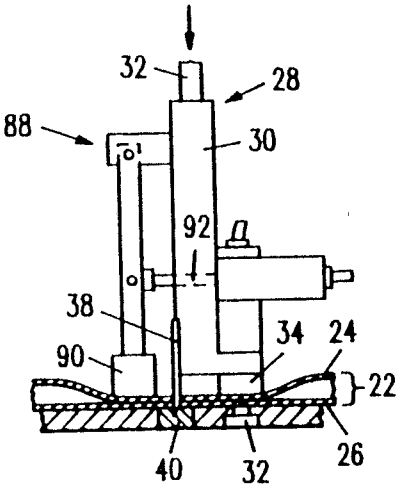
FIG. 4 is a side view of the portion of the embodiment shown in FIG. 3 in which the sealing and perforating means are in a lowered position.

FIGS. 3, 4 and 5 illustrate the method utilizing movement of first layer 24 in a direction substantially opposite to direction of production "a". This step, of course, is preceded with the perforating and sealing steps. The actuating member 30 shown in these figures also includes a kicker member 88, having a foot 90 at one end and is hinged to actuating member 30 at the other end. Kicker 88 is disposed on actuating member 30 such that foot 90 is near first layer 24 of tubing 22 when actuating member 30 is in the upward position and is in contact with first layer 24 when actuating member 30 is in the downward position. Kicker 88 is also attached to actuating member 30 by a pneumatically driven cylinder 92 at approximately the middle of its length.

In operation, when actuating member 30 is in the downward position, foot 90 of kicker 88 is in contact with upper layer 24 of tubing 22. After the perforating and sealing steps have been completed, but while perforating blade 38 is still embedded in anvil 40 and pressure member 34 is still in contact with tubing 22, cylinder 92 extends and pushes kicker 88 in a direction substantially opposite to direction of production "a". This extension of cylinder 92 causes foot 90 to contact and engage first layer 24. If sufficient friction exists between foot 90 and first layer 24, tubing 22 will tear on its upper surface at the line of perforation made by perforating blade 38. The result is a bag open on one side and still physically connected to the continuous length of tubing by its lower layer.

Of course, foot 90 should be comprised of a material which will cause sufficient friction with the material which comprises tubing 22 such that first layer 24 will move with foot 90 when extended. The amount of pressure applied to first layer 24 by foot 90 is another factor. Although some amount of pressure is required to obtain the desired result, it can be appreciated that an overabundance of pressure will cause both first layer 24 and second layer 26 to tear from the remainder of tubing 22 at the line of perforation.

It has been discovered that the method works well where the material which comprises tubing 22 is polyethylene and the material which comprises foot 90 is common rubber. The relatively low friction between first layer 24 and second layer 26 when comprised of polyethylene allows first layer 24 to slide over second layer 26 and move easily without substantially disturbing the position of second layer 26.

Figure 10:
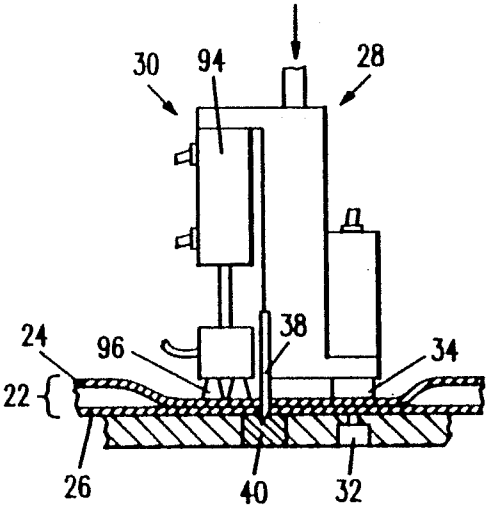
FIG. 10 is a side view of a portion of an alternate embodiment of the present invention wherein the sealing means and perforating means are shown in the lowered position and wherein a suction member is frictionally engaging with the first layer of the continuous tubing.
Figure 11:
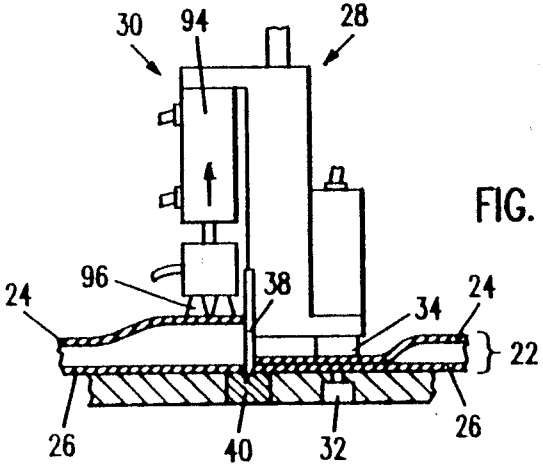
FIG. 11 is a side view of a portion of an alternate embodiment as shown in FIG. 9 wherein the sealing means and perforating means are shown in the lowered position and wherein the suction member is frictionally engaging and severing the first layer of the continuous tubing at a line of perforation.
Figure 9:
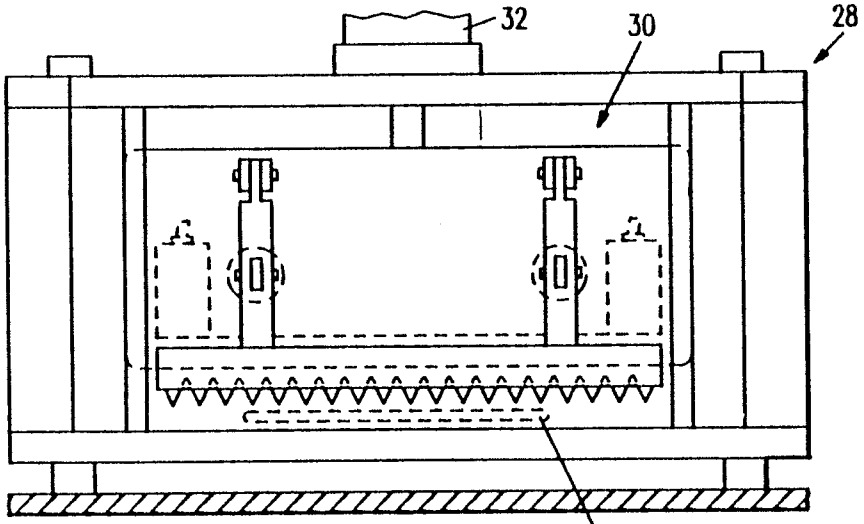
FIG. 9 is a cross sectional view of the device shown in FIG. 8 along line 9—9.

An alternate method and device which accomplishes the desired one-sided severing is shown in FIGS. 10 and 11. In that embodiment, the kicker on actuating member 30 is replaced with a pneumatically driven cylinder 94 having suction cups 96 at its end in lieu of a rubber foot. Cylinder 94 is disposed on actuating member 30 such that suction cups 96 are near first layer 24 of tubing 22 when actuating member 30 is in the upward position and is in contact with first layer 24 when actuating member 30 is in the downward position.

In operation, when actuating member 30 is in the downward position, suction cups 96 are pushed against first layer 24 and become temporarily attached to first layer 24 by suction. After the perforating and sealing steps have been completed, but while perforating blade 38 is still embedded in anvil 40 and pressure member 34 is still in contact with tubing 22, cylinder 94 recedes and raises suction cups 96 upward in a direction substantially perpendicular to direction of production "a" and severs first layer 24 at the line of perforation from the remainder of tubing 22. Again, the result is a bag open on one side and still physically connected to the continuous length of tubing by its lower layer.

As illustrated by the foregoing, the present invention provides a useful method and apparatus for producing a length of continuous bags and for producing continuous bags wherein said bags are open on one side.

Figure 6:
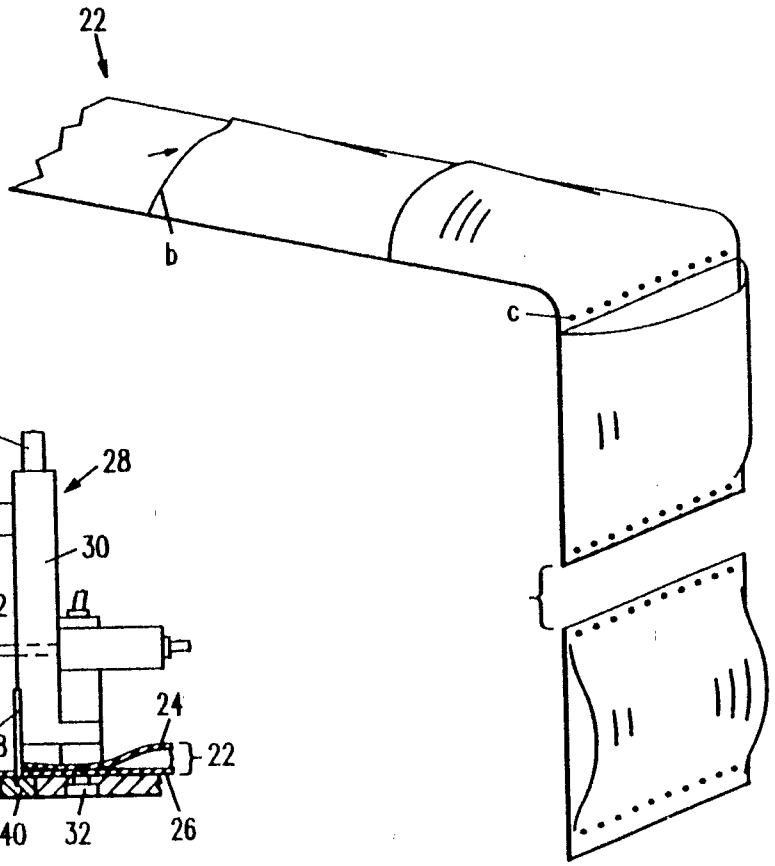
FIG. 6 is a perspective view of a portion of the continuous tubing used with the present invention illustrating how the bags produced can be filled with material immediately after production.

These resulting continuous bags have one open side. The device and method of the present invention are useful in industries in which material or products are packaged in bags. In such cases, instead of the finished bags being rolled up in an uptake reel, that can be made to hang over one end of the horizontal member as shown in FIG. 6 and actually be filled with material as the bags are being produced.

Figure 13:
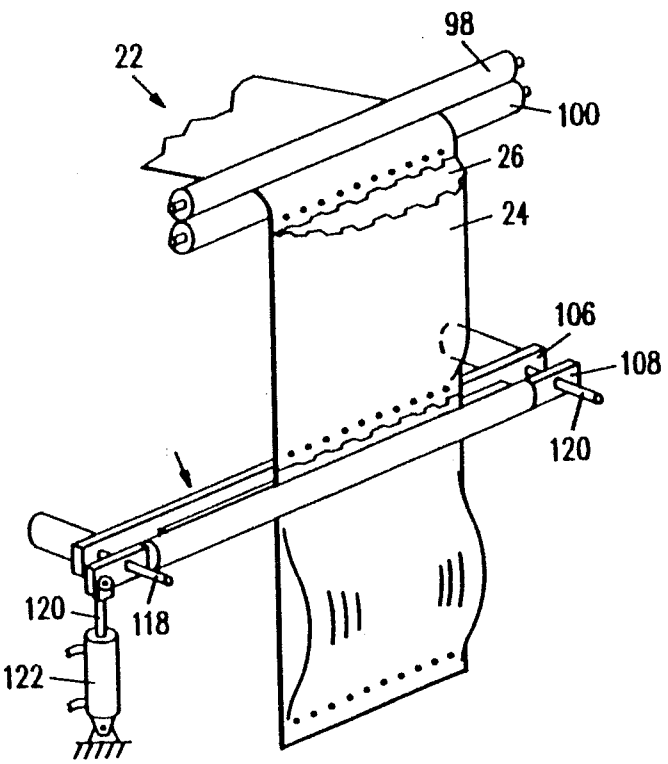
FIG. 13 is a perspective view of a portion of the continuous bags produced by the present invention illustrating how the bags produced, after being blown open as shown in FIG. 12, can be sealed.
Figure 12:
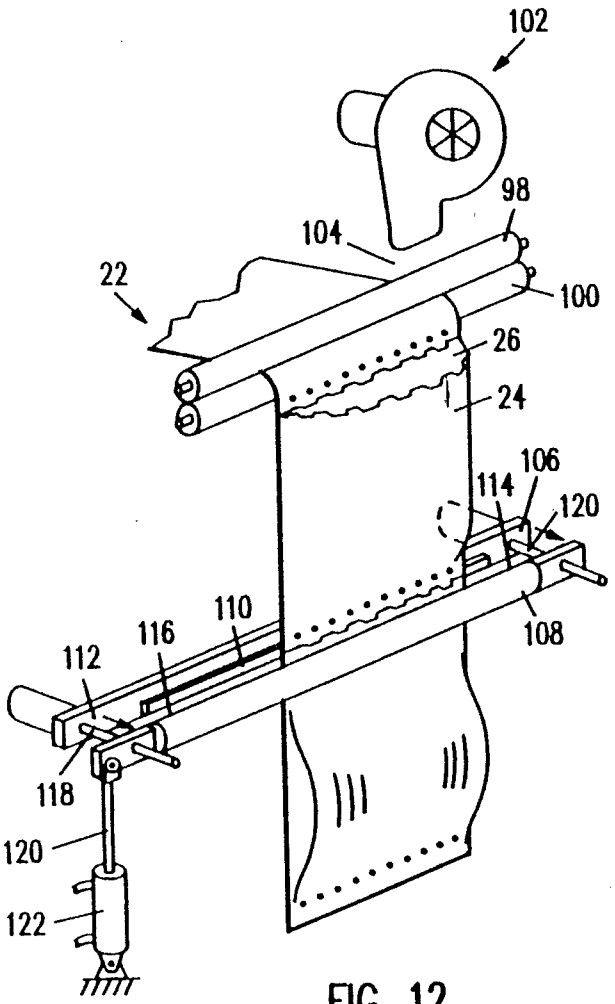
FIG. 12 is a perspective view of a portion of the continuous bags produced by the present invention illustrating how the openings of the bags produced can be blown open with air immediately after production.

In an alternate embodiment, as shown in FIGS. 12 and 13, a pair of rollers 98 and !00 replace roller 58 and the finished continuous length of partially severed bags is made to pass therebetween and hang over that end of horizontal member 12. An air blower assembly 102, having a nozzle 104, is disposed above the device such that nozzle 104 is directly above the end of the device and the bags are directly under nozzle 104. In operation, the opened bags pass through roller 98 and 100 and stop such that their openings are open to nozzle 104 which blows air from air blower assembly 102 and opens the bags where they were previously partially severed as they pass thereunder. Thereafter, the continuous length of air opened bags may be filled with any desired material and is advanced downward toward a second sealing means. The second sealing means comprises two spaced apart parallel horizontal rods 106 and 108 through which the filled bags pass. A heating element 110 is disposed on the inner surface 112 of horizonal rod 106 and a pressure member 114 positioned directly opposite heating element 110 is disposed on inner surface 116 of horizontal rod 108. Horizontal rods 106 and 108 are disposed on the device directly below rollers 98 and 100 and a sufficient distance away therefrom such that the filled bags pass between them. Horizonal rods 106 and 108 are separated by a pair of pneumatically driven cylinders 118 and 120 disposed on either ends of rods 106 and 108. In operation, cylinders 118 and 120 compress and expand to clamp the length of filled bags at a point near an opening. As can be appreciated, the filled bags are sealed by being clamped between horizontal rods 106 and 108. Rod 108 is connected to a vertical arm 120 which is capable of vertical motion toward and away from rollers 98 and 100. Vertical arm 108 is pneumatically driven by a cylindrical driving mechanism 122. While rods 106 and 108 are clamped about a bag and after the second sealing means completes the sealing step, vertical arm 122 retracts and pulls the bag away from rollers 98 and 100 and servers the bag at the line of perforation at second layer 26. As can be appreciated, these steps can be repeated and will result in a series of severed bags having two sealed ends.

Although the foregoing invention has been described in some detail by way of illustration for purposes of clarity of understanding, it will be understood that numerous modifications may be practiced within the spirit and scope of the appended claims.

I claim:

1. A method for producing a plurality of continuous bags along a direction of production wherein each bag has a sealed end and a line of perforation opposite to said sealed end, each bag positioned with its sealed end immediately adjacent to the line of perforation of an adjacent bag, said method comprising the steps of:

supplying a continuous length of advancing tubing along said direction of production, said tubing having a first layer and a second layer;

sealing the first and second layers of said tubing together at a first location by a sealing means to form a sealed end of a first bag;

substantially simultaneously thereto, perforating the first and second layers of said tubing at a second location immediately adjacent to said sealed end by a perforating means, to form a line of perforation of a second bag, said second bag immediately adjacent to said first bag;

frictionally engaging said first layer of said tubing by maintaining engaging means substantially perpendicularly to said direction of production near said line of perforation;

severing the first layer of said tubing at said line of perforation without substantially severing the second layer of said tubing by moving said engaging means while engaged with said first layer of said tubing relative to said second layer of said tubing in a direction substantially opposite to said direction of production; and advancing said tubing along said direction of production past said sealing means and past said perforating means to form said plurality of continuous bags.

2. The method according to claim 1 wherein said perforating step further comprises:

moving a perforating blade in a direction substantially perpendicular to said direction of production against said first layer of said tubing and through said first and second layers of said tubing.

3. The method according to claim 1 wherein said advancing step further comprises:

periodically moving said tubing an incremental distance along said distance of production wherein the incremental distance is substantially equal to the length of said bags.

4. The method according to claim 3 wherein said incremental distance is adjustable.

5. An apparatus for producing a plurality of continuous bags from a continuous length of tubing, said tubing having a first layer and a second layer, along a direction of production wherein each bag has a sealed end and a line of perforation opposite to said sealed end, each bag positioned with its sealed end immediately adjacent to the line of perforation of an adjacent bag, said apparatus comprising:

means for sealing the first and second layers of said tubing together at a first location to form a sealed end of a first bag;

means for perforating the first and second layers of said tubing at a second location immediately adjacent to said sealed end to form a line of perforation of a second bag, said second bag immediately adjacent to said first bag;

means for actuating said sealing means and said perforating means substantially simultaneously;

engaging means for frictionally engaging said first layer of said tubing in a direction substantially perpendicular to said direction of production; said engaging means positioned substantially near said line of perforation;

means for severing the first layer of said tubing at said line of perforation without substantially severing the second layer of said tubing wherein said severing means comprises means for pivotally actuating said engaging means, in a direction substantially opposite to the direction of production; and means for advancing said tubing along said direction of production past said sealing means and past said perforating means to form said plurality of continuous bags.

6. The apparatus according to claim 5 wherein said means for perforating further comprises:

a perforating blade for moving in a direction substantially perpendicular to said direction of production against said first layer of said tubing and through said first and second layers of said tubing.

7. The apparatus according to claim 5 wherein said means for advancing further comprises:

means for periodically moving said tubing an incremental distance along said direction of production wherein the incremental distance of substantially equal to the length of said bags.

8. The apparatus according to claim 5 wherein said means for advancing said tubing in said direction of production further comprises:

a member for physically engaging said tubing at a first position and disengaging said tubing at a second position, wherein the distance between said first position and saad second position is substantially equal to the length of said bags.

9. The apparatus according to claim 8 wherein said distance between said first position and said second position is adjustable.

* * * * *